US009024603B2

(12) United States Patent
Friend et al.

(10) Patent No.: US 9,024,603 B2
(45) Date of Patent: May 5, 2015

(54) LOW POWER CURRENT COMPARATOR FOR SWITCHED MODE REGULATOR

(71) Applicant: Conexant Systems, Inc., Newport Beach, CA (US)

(72) Inventors: Brian W. Friend, Carlsbad, CA (US); Kyehyung Lee, Irvine, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 88 days.

(21) Appl. No.: 13/755,575

(22) Filed: Jan. 31, 2013

(65) Prior Publication Data

US 2013/0200872 A1 Aug. 8, 2013

Related U.S. Application Data

(60) Provisional application No. 61/593,757, filed on Feb. 1, 2012.

(51) Int. Cl.
*G05F 1/10* (2006.01)

(52) U.S. Cl.
CPC ..... *G05F 1/10* (2013.01)

(58) Field of Classification Search
CPC ..... G05F 1/10; G05F 1/46; G05F 1/625
USPC ..... 323/282–285, 292, 311, 312
See application file for complete search history.

(56) References Cited

U.S. PATENT DOCUMENTS

| | | | | |
|---|---|---|---|---|
| 7,615,977 | B2 * | 11/2009 | Gicquel et al. | 323/273 |
| 8,278,900 | B2 | 10/2012 | Strijker et al. | |
| 8,283,901 | B2 | 10/2012 | Lopata et al. | |
| 2013/0003422 | A1 | 1/2013 | Persson et al. | |

FOREIGN PATENT DOCUMENTS

| | | | | |
|---|---|---|---|---|
| WO | WO 9505033 | A1 * | 2/1995 | H03K 19/018 |

* cited by examiner

*Primary Examiner* — Adolf Berhane
*Assistant Examiner* — Yemane Mehari
(74) *Attorney, Agent, or Firm* — Haynes and Boone, LLP

(57) ABSTRACT

A current comparator comprising a first NMOS transistor having a drain coupled to $V_{DD}$, a source and a gate. A first PMOS transistor having a source coupled to the source of the first NMOS transistor to form an input, a drain coupled to $V_{SS}$ and a gate coupled to the gate of the first NMOS transistor. A second NMOS transistor having a drain coupled to $V_{DD}$, a source and a gate coupled to the input. A first bias current source having an input coupled to the source of the second NMOS transistor and an output. A second bias current source having an input coupled to the drain of the first NMOS transistor and an output coupled to the gate of the first NMOS transistor. A third NMOS transistor having a drain coupled to the gate of the first NMOS transistor to form an output, a source and a gate.

18 Claims, 3 Drawing Sheets

300
$V_{DD}$
302
306
310
314
318
$I_{IN}$
$V_{OUT}$
316
320
$V_{REF}$
304
308
312
$I_{BIAS}$
$V_{SS}$

LOW POWER CURRENT COMPARATOR FOR SWITCHED MODE REGULATOR

RELATED APPLICATIONS

The present application claims benefit of U.S. provisional patent application 61/593,757, filed Feb. 1, 2012, which is hereby incorporated by reference for all purposes.

TECHNICAL FIELD

The present disclosure relates generally to switched mode regulators, and more specifically to a low power current comparator for switched mode regulators.

BACKGROUND OF THE INVENTION

Switched mode regulators are used in a variety of applications. Switched mode regulators rapidly switch a series device on and off. The duty cycle of the switch sets how much charge is transferred to the load. Because the series element is either fully conducting or switched off, it dissipates almost no power, which gives the switching design its efficiency. Switching regulators are also able to generate output voltages which are higher than the input, or of opposite polarity.

SUMMARY OF THE INVENTION

In accordance with an exemplary embodiment of the present disclosure, a low power current comparator for switched mode regulators is provided. The current comparator includes an output stage, such as with feedback clamp transistors coupled to a level-shifted NMOS inverting amplifier.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
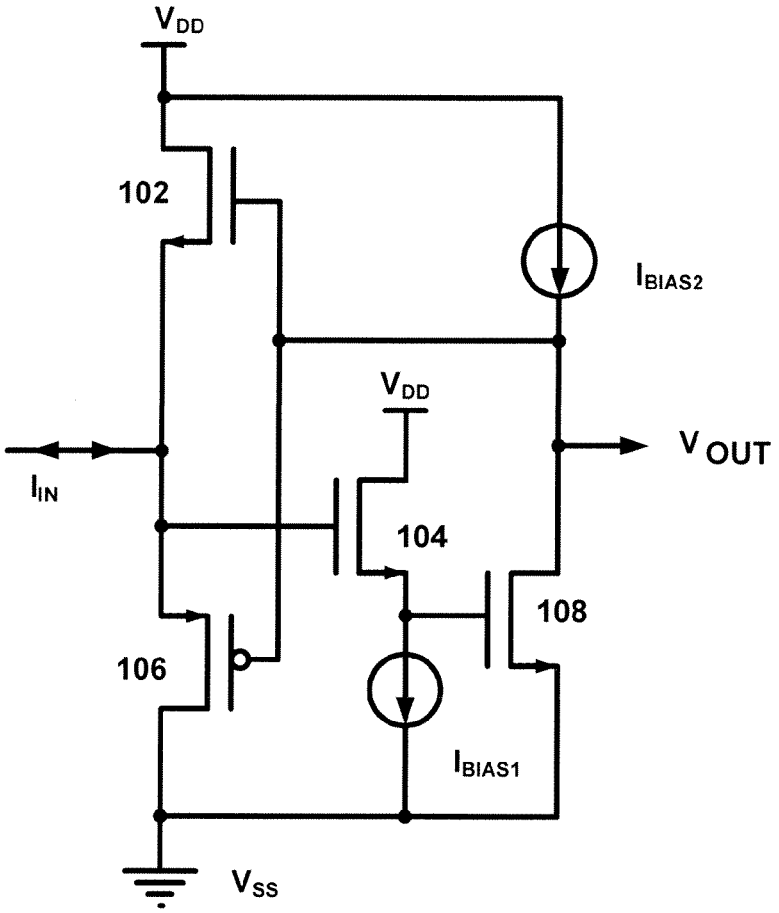
FIG. 1 is a diagram of a current comparator output stage in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

Power efficiency is an important performance metric for switched mode regulators. The internal circuitry of a switched mode regulator should consume as little power as possible and should also have design simplicity, as long as the power requirements and design simplicity do not impair or compromise performance. In order to provide maximum efficiency, though, it is often necessary to include a complex assortment of internal housekeeping circuitry for a switched mode regulator, to monitor performance and appropriately control modes of operation.

One important circuit for a switched mode regulator is the voltage comparator. The ideal characteristics of the voltage comparator are that it should compare either voltages or currents accurately and provide a digital output as rapidly as possible in accordance with the comparison of the input signals. The majority of comparison applications are used to compare two voltages. An un-buffered open-loop operational amplifier such as an operational transconductance amplifier (OTA) can be used to topologically meet the requirements for a voltage comparator.

The output of an OTA responds slowly to the difference of two input voltages, especially when operating at low current. The limited slew rate capability as well as the output voltage not being biased in the linear region once the output has reached a "1" or a "0" (such as when the output voltage has saturated to $V_{DD}$ or $V_{SS}$) are obstacles in achieving high speed operation.

To overcome these limitations, a current comparator output stage can be added. A current comparator output stage keeps the operational amplifier high-impedance output voltage constant. The current comparator cell senses the differences in comparator input voltages as currents. One embodiment of a current comparator for this application is called the 'Traff' circuit, which draws a continuous current load and which therefore has high power and current requirements. The disclosed exemplary current comparator output stages retain the main benefits of the Traff circuit for use as an output stage for a current comparator while reducing the power and current requirements of the current comparator.

FIG. 1 is a diagram of a current comparator output stage 100 in accordance with an exemplary embodiment of the present disclosure. Current comparator output stage 100 can be implemented in silicon, gallium arsenide or other suitable materials, and can be constructed from discrete devices, formed as an integrated circuit, or can be constructed in other suitable manners.

Current comparator output stage 100 includes NMOS transistor 102 and PMOS transistor 106, which form a feedback clamp. The source of NMOS transistor 102 is coupled to the source of PMOS transistor 106 to provide a negative feedback complementary $V_{GS}$ clamp, which provides negative feedback and prevents the output voltage from swinging to either rail voltage. As used herein, the term "couple" and its cognate terms such as "couples" and "coupled" can include a direct connection, a connection through intervening devices or elements, a hard-wired connection, an integrated circuit connection, a bus or other suitable connections.

The gate of NMOS transistor 104 is also coupled to the source of NMOS transistor 102 and the source of PMOS transistor 106. $I_{BIAS1}$ is coupled to the source of NMOS transistor 104 and the gate of NMOS transistor 108 to form a level-shifted common source NMOS inverting amplifier. The supply current to current comparator output stage 100 is limited by current source $I_{BIAS2}$, which is coupled between $V_{DD}$ and the drain of NMOS transistor 108. The voltage at the $I_{IN}$ node is determined by selection of the device sizes, and can be set at the sum of $V_{GS}$ for NMOS transistors 104 and 108.

When current is flowing into the input node, NMOS transistor 102 is turned off and PMOS transistor 106 is turned on, and current comparator output stage 100 generates a low output voltage that is approximately equal to $V_{GS}$ of PMOS transistor 106 plus $V_{SS}$. When current flows out of the input node, NMOS transistor 102 is turned on and PMOS transistor 106 is turned off, and current comparator output stage 100 generates a high output voltage that is approximately equal to $V_{DD}$ minus $V_{GS}$ of NMOS transistor 102. The current consumed by current comparator output stage 100 is thus limited to $I_{BIAS1}$ and/or $I_{BIAS2}$ depending on the output. In this manner, NMOS transistors 104 and 108 form a current limited inverter.

Current comparator output stage 100 can be used to replace a high current inverter amplifier stage with a current limited amplifier stage. The use of a current limited amplifier stage reduces the required power supply current for the current comparator cell and the associated switched mode regulator.

Figure 2:
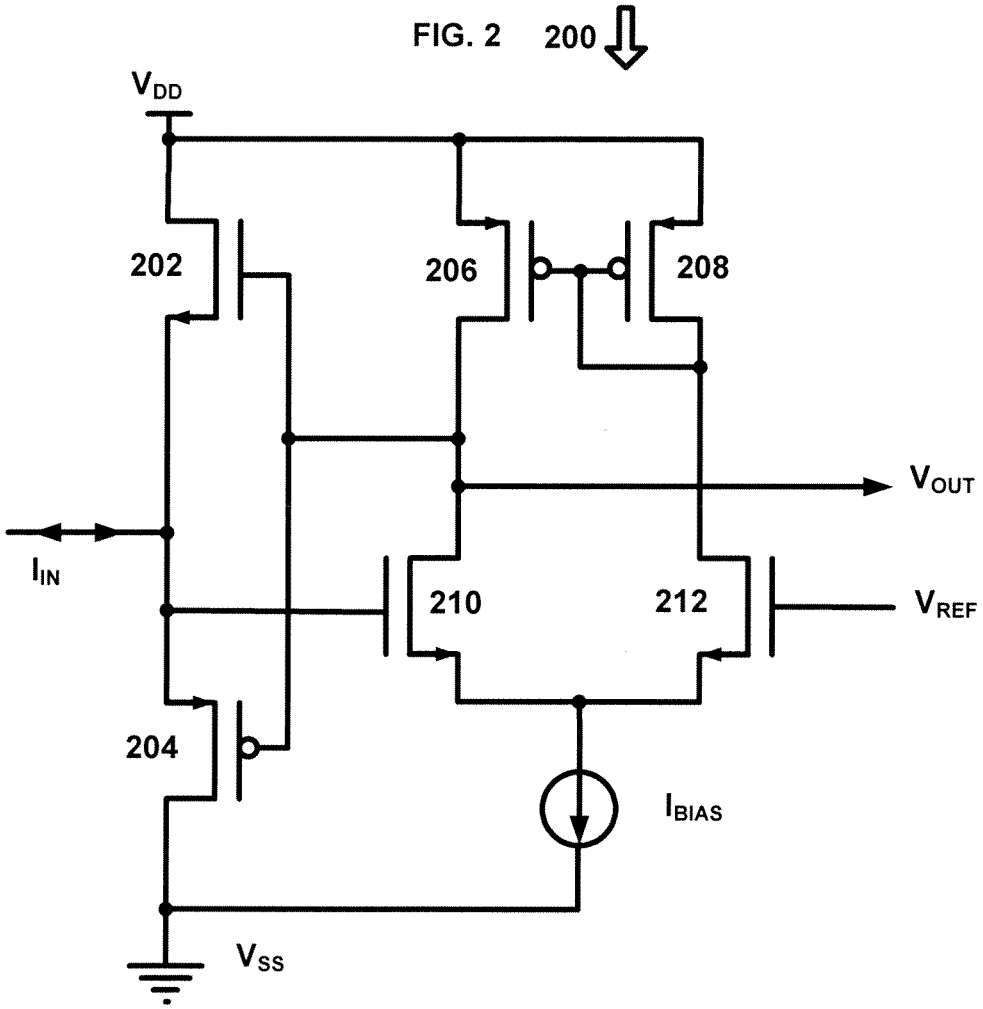
FIG. 2 is a diagram of a current comparator output stage in accordance with an exemplary embodiment of the present disclosure.

FIG. 2 is a diagram of a current comparator output stage 200 in accordance with an exemplary embodiment of the present disclosure. The source of NMOS transistor 202 is coupled to the source of PMOS transistor 204 to provide a negative feedback complementary $V_{GS}$ clamp. The gate of PMOS transistor 206 is coupled to the gate of PMOS transistor 208. The gate of NMOS transistor 210 is coupled to the gate of NMOS transistor 212. PMOS transistors 206 and 208 are connected in series to NMOS transistors 210 and 212 and to $I_{BIAS}$ to form a simple differential inverting gain stage. The current consumed by current comparator output stage 200 is limited by $I_{BIAS}$. The voltage at the $I_{IN}$ node is determined by $V_{REF}$ and negative feedback connection of the differential amplifier, which allows the voltage to be set closer to $V_{DD}/2$ or to other suitable values.

Figure 3:
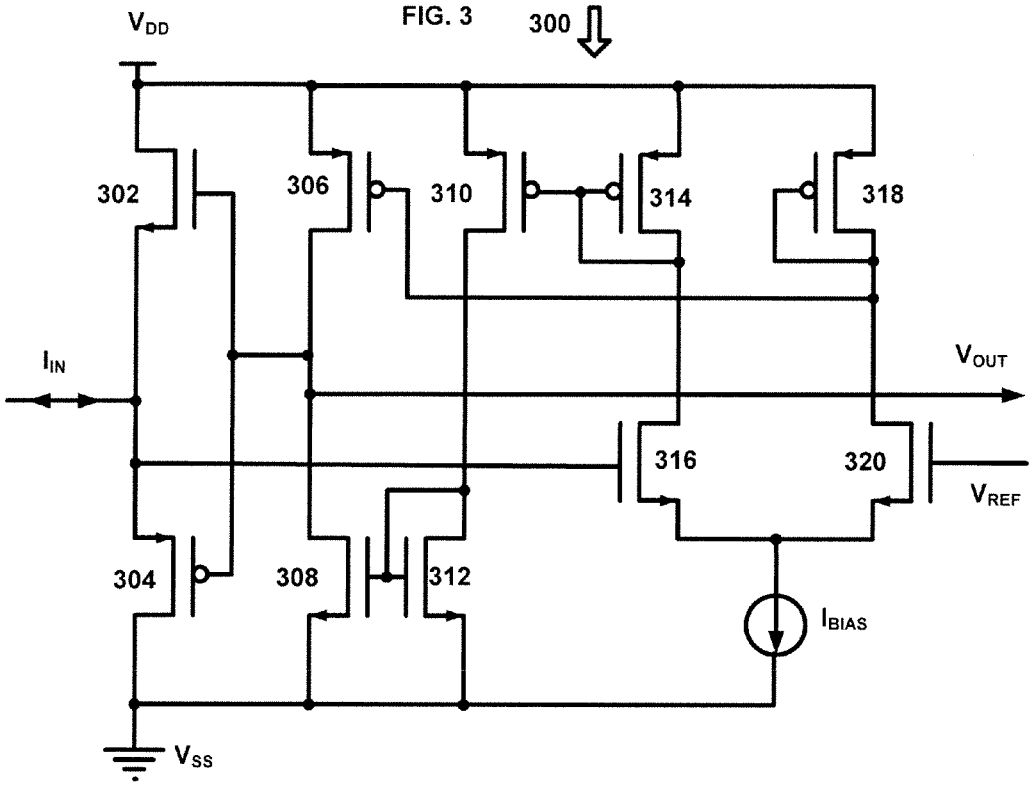
FIG. 3 is a diagram of a current comparator output stage in accordance with an exemplary embodiment of the present disclosure.

FIG. 3 is a diagram of a current comparator output stage 300 in accordance with an exemplary embodiment of the present disclosure. The source of NMOS transistor 302 is coupled to the source of PMOS transistor 304 to provide a negative feedback complementary $V_{GS}$ clamp. PMOS transistors 306, 310, 314 and 318, NMOS transistors 308, 312, 316 and 320 and $I_{BIAS}$ form a simple differential current mirror amplifier. The current consumed by current comparator output stage 300 is limited by $I_{BIAS}$. The voltage at the $I_{IN}$ node is determined by $V_{REF}$ and negative feedback connection of the differential amplifier. This embodiment provides a more accurate location of the $I_{IN}$ node voltage and is more symmetric in operation. Likewise, other suitable amplifier stages can also or alternatively be used.

In operation, the disclosed current comparator output stages can be used to provide a current comparator that requires much lower power than known current comparators. The power supply currents are limited and controlled by accurate current references, which are readily available.

Figure 4:
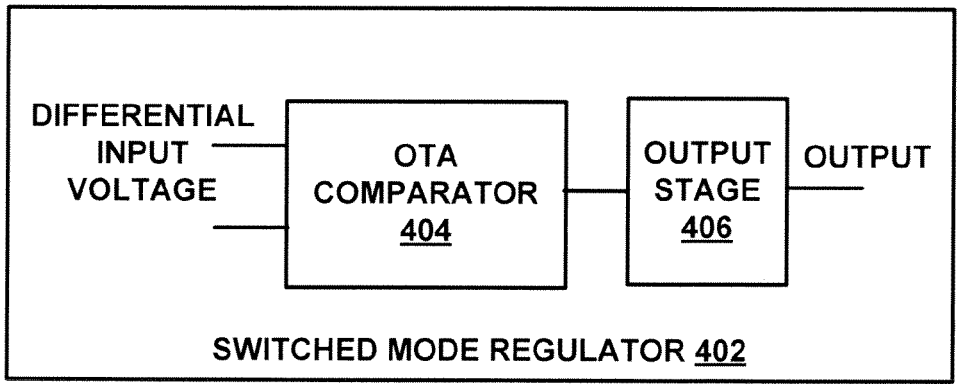
FIG. 4 is a diagram of a switched mode regulator in accordance with an exemplary embodiment of the present disclosure.

FIG. 4 is a diagram of a switched mode regulator 400 in accordance with an exemplary embodiment of the present disclosure. Switched mode regulator 400 includes OTA comparator 404, which receives a differential input voltage and which is coupled to output stage 406, which can be one of the exemplary disclosed output stages of FIGS. 1 through 3 or other suitable output stages that can be used to provide a current comparator that requires much lower power than known current comparators.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A switched mode regulator comprising
- a feedback clamp stage receiving a current input; and
- a current limited inverting amplifier stage coupled to the feedback clamp stage, the current limited inverting amplifier stage including:
  - a first PMOS transistor having a source coupled to $V_{DD}$, a drain and a gate;
  - a second PMOS transistor having a source coupled to $V_{DD}$, a drain and a gate;
  - a third PMOS transistor having a source coupled to $V_{DD}$, a drain and a gate;
  - a fourth PMOS transistor having a source coupled to $V_{DD}$, a drain and a gate; and
  - a first NMOS transistor having a drain coupled to the drain of the first PMOS transistor to form an output. a gate and a source;
- wherein the current limited inverting amplifier stage outputs a low voltage value when current flows into the current input and a high voltage value when current flows out of the current input.

2. The switched mode regulator of claim 1 further comprising a voltage reference input to the current limited inverting amplifier stage, the current limited inverting amplifier stage controlling a voltage of the current input as a function of the voltage reference.

3. The switched mode regulator of claim 1 wherein the current limited inverting amplifier stage comprises a level-shifted common source NMOS inverting amplifier.

4. The switched mode regulator of claim 1 wherein the current limited inverting amplifier stage comprises a differential inverting gain stage.

5. The switched mode regulator of claim 1 wherein the current limited inverting amplifier stage comprises a differential current mirror amplifier.

6. The switched mode regulator of claim 1 wherein the current limited inverting amplifier stage comprises:
- a first bias current source having an input coupled to the source of the first NMOS transistor and an output coupled to $V_{SS}$;
- a second bias current source coupled to the feedback clamp stage; and
- a second NMOS transistor having a drain coupled to the feedback clamp stage to form an output, a source coupled to $V_{SS}$ and a gate coupled to the source of the first NMOS transistor.

7. The switched mode regulator of claim 1 wherein the feedback clamp stage comprises:
- a first NMOS transistor having a drain coupled to $V_{DD}$, a source and a gate; and
- a first PMOS transistor having a source coupled to the source of the first NMOS transistor to form an input, a drain coupled to $V_{SS}$ and a gate coupled to the gate of the first NMOS transistor.

8. The switched mode regulator of claim 1 wherein the current limited inverting amplifier stage further comprises a second NMOS transistor having a drain coupled to the drain of the second PMOS transistor, a gate coupled to a reference voltage and a source.

9. The switched mode regulator of claim 8 wherein the current limited inverting amplifier stage further comprises a first bias current source having an input coupled to the source of the first NMOS transistor and the source of the second NMOS transistor and an output coupled to $V_{SS}$.

10. The switched mode regulator of claim 1 further comprising a second NMOS transistor having a drain coupled to the drain of the second PMOS transistor, a gate coupled to the gate of the first NMOS transistor and a source.

11. The switched mode regulator of claim 10 further comprising a third NMOS transistor having a drain coupled to the drain of the third PMOS transistor, a gate coupled to the input and a source.

12. The switched mode regulator of claim 11 further comprising a fourth NMOS transistor having a drain coupled to the drain of the fourth PMOS transistor, a gate coupled to a reference voltage and a source.

13. The switched mode regulator of claim 12 further comprising a first bias current source having an input coupled to the source of the third NMOS transistor and the source of the fourth NMOS transistor and an output coupled to $V_{SS}$.

14. A switched mode regulator comprising:

a first NMOS transistor having a drain coupled to $V_{DD}$, a source and a gate;

a first PMOS transistor having a source coupled to the source of the first NMOS transistor to form an input, a drain coupled to $V_{SS}$ and a gate coupled to the gate of the first NMOS transistor;

a second NMOS transistor having a chain coupled to $V_{DD}$, a source and a gate coupled to the input;

a first bias current source having an input coupled to the source of the second NMOS transistor and an output coupled to $V_{SS}$;

a second bias current source having an input coupled to the drain of the first NMOS transistor and an output coupled to the gate of the first NMOS transistor; and a third NMOS transistor having a drain coupled to the gate of the first NMOS transistor to form an output, a source coupled to $V_{SS}$ and a gate coupled to the source of the second NMOS transistor.

15. A switched mode regulator comprising:

a first NMOS transistor having a drain coupled to $V_{DD}$, a source and a gate;

a first PMOS transistor having a source coupled to the source of the first NMOS transistor to form an input, a drain coupled to $V_{SS}$ and a gate coupled to the gate of the first NMOS transistor;

a second PMOS transistor having a source coupled to $V_{DD}$, a drain and a gate; and a third PMOS transistor having a source coupled to $V_{DD}$, a drain and a gate coupled to the gate of the second PMOS transistor and to the drain of the third PMOS transistor.

16. The switched mode regulator of claim 15 further comprising a second NMOS transistor having a drain coupled to the drain of the second PMOS transistor, a gate coupled to the input and a source.

17. The switched mode regulator of claim 16 further comprising a third NMOS transistor having a drain coupled to the drain of the third PMOS transistor, a gate coupled to a reference voltage and a source.

18. The switched mode regulator of claim 17 further comprising a first bias current source having an input coupled to the source of the second NMOS transistor and the source of the third NMOS transistor and an output coupled to $V_{SS}$.

* * * * *